US011426848B2

(12) United States Patent
Alberding et al.

(10) Patent No.: US 11,426,848 B2
(45) Date of Patent: Aug. 30, 2022

(54) SETTING METHOD FOR THREADING CONNECTION BY MEANS OF IMPACT WRENCH

(71) Applicant: Hilti Aktiengesellschaft, Schaan (LI)

(72) Inventors: Matthaeus Alberding, Lindau (DE); Dario Bralla, Buchs (CH); Antonio Orvieto, Goetzis (AT)

(73) Assignee: Hilti Aktiengesellschaft, Schaan (LI)

( * ) Notice: Subject to any disclaimer, the term of this patent is extended or adjusted under 35 U.S.C. 154(b) by 67 days.

(21) Appl. No.: 16/955,325

(22) PCT Filed: Dec. 20, 2018

(86) PCT No.: PCT/EP2018/086300
§ 371 (c)(1),
(2) Date: Jun. 18, 2020

(87) PCT Pub. No.: WO2019/122189
PCT Pub. Date: Jun. 27, 2019

(65) Prior Publication Data

US 2021/0008698 A1 Jan. 14, 2021

(30) Foreign Application Priority Data

Dec. 20, 2017 (EP) ..... 17208763

(51) Int. Cl.
*B25B 23/147* (2006.01)
*B25B 21/02* (2006.01)
*B25F 5/00* (2006.01)

(52) U.S. Cl.
CPC ..... *B25B 23/1475* (2013.01); *B25B 21/02* (2013.01); *B25D 2250/175* (2013.01);
(Continued)

(58) Field of Classification Search
CPC ..... B25B 23/1475; B25B 21/02; B25D 2250/175; B25D 2250/195; B25D 2250/201; B25D 2250/205; B25F 5/001
(Continued)

(56) References Cited

U.S. PATENT DOCUMENTS 3,207,237 A * 9/1965 Wanner ..... B25B 21/02 173/93.5
4,037,282 A * 7/1977 Dahl ..... B21K 1/44 470/11
(Continued)

FOREIGN PATENT DOCUMENTS

DE 10 2005 615 900 A1 2/2006
EP 2 305 432 A2 4/2011
(Continued)

OTHER PUBLICATIONS

PCT/EP2018/086300, International Search Report dated Mar. 26, 2019 (Two (2) pages).

*Primary Examiner* — Robert F Long
(74) *Attorney, Agent, or Firm* — Crowell & Moring LLP

(57) ABSTRACT

A control method for tightening a threaded connection executes, in response to actuation of a pushbutton key, a sequence with consecutive phases. In a first phase, an impact mechanism of an impact wrench exerts a predefined number of rotary impacts on the threaded connection. During the first phase, a profile of a rotational angle over time is estimated. A pattern is adapted to the profile and on the basis of the pattern a setpoint torque is determined for a second phase and a final rotational angle or a final number of impacts is determined for a third phase. During the second phase, rotary impacts are exerted until an estimated torque reaches the setpoint torque. During the third phase, rotary impacts are exerted on the threaded connection until a
(Continued)

number of rotary impacts corresponds to the final number or a rotational angle corresponds to the final rotational angle.

3 Claims, 3 Drawing Sheets

(52) U.S. Cl.
CPC .. *B25D 2250/195* (2013.01); *B25D 2250/201* (2013.01); *B25D 2250/205* (2013.01); *B25F 5/001* (2013.01)

(58) Field of Classification Search
USPC ..... 173/1–11, 176
See application file for complete search history.

(56) References Cited

U.S. PATENT DOCUMENTS 4,095,325 A * 6/1978 Hashimoto ..... B25B 23/147 29/407.03
4,161,221 A * 7/1979 Carlin ..... B25B 23/14 173/1
4,173,059 A * 11/1979 Hashimoto ..... B25B 23/147 29/240
4,358,735 A * 11/1982 Boys ..... B25B 23/14 340/672
4,733,049 A * 3/1988 Lemelson ..... B23B 49/001 219/121.65
4,967,472 A * 11/1990 Ebihara ..... B21D 7/12 29/712
5,065,494 A * 11/1991 Ebihara ..... B21D 7/12 29/407.03
5,105,519 A * 4/1992 Doniwa ..... B23P 19/066 173/1
5,277,261 A * 1/1994 Sakoh ..... B25B 21/02 173/109
5,289,885 A * 3/1994 Sakoh ..... B25B 23/1405 173/109
5,457,866 A * 10/1995 Noda ..... B25B 21/026 29/407.02
5,567,886 A * 10/1996 Kettner ..... B25B 23/1456 73/862.21
5,848,655 A * 12/1998 Cooper ..... B25B 21/02 173/176
5,951,581 A * 9/1999 Saadat ..... A61B 17/320758 606/170
6,371,218 B1 * 4/2002 Amano ..... B25B 23/1405 173/176
6,516,896 B1 * 2/2003 Bookshar ..... B23P 19/066 173/1
6,536,536 B1 * 3/2003 Gass ..... B23B 31/123 173/171
6,618,923 B1 * 9/2003 Quickert ..... B23P 19/066 29/407.02
7,428,934 B2 * 9/2008 Arimura ..... B25B 23/1475 173/104
8,485,273 B2 * 7/2013 Elsmark ..... B25B 23/147 173/1
8,875,804 B2 * 11/2014 Puzio ..... B25F 5/003 173/2
10,343,268 B2 * 7/2019 Hirabayashi ..... B25B 21/02
10,427,282 B2 * 10/2019 Ishikawa ..... B25B 21/02
10,589,407 B2 3/2020 Gaul
2002/0134172 A1 * 9/2002 Yamada ..... B25B 21/02 73/862.21
2003/0090227 A1 * 5/2003 Ito ..... B25B 23/1405 318/434
2004/0040727 A1 * 3/2004 Miller ..... B25B 21/00 173/2
2004/0182588 A1 * 9/2004 Tokunaga ..... B25B 23/1475 173/2
2005/0045353 A1 * 3/2005 Kawai ..... B25B 21/02 173/181
2005/0109519 A1 * 5/2005 Kawai ..... B25B 21/026 173/183
2005/0263305 A1 * 12/2005 Shimizu ..... B25B 23/1405 173/2
2006/0125428 A1 * 6/2006 Schulze ..... D06F 35/007 318/53
2008/0099217 A1 * 5/2008 Seith ..... B25B 21/026 173/1
2008/0230245 A1 * 9/2008 Matsunaga ..... B25B 23/141 173/4
2008/0319570 A1 * 12/2008 Van Schoiack ..... B23P 19/06 700/110
2009/0084568 A1 * 4/2009 Arimura ..... B25B 23/1475 173/104
2009/0250233 A1 * 10/2009 Wallace ..... B25B 23/1405 173/1
2010/0059240 A1 * 3/2010 Schmidt ..... B25B 21/00 173/1
2011/0214894 A1 * 9/2011 Harada ..... B25B 21/02 173/181
2011/0303427 A1 * 12/2011 Tang ..... G05D 17/02 173/1
2012/0136474 A1 * 5/2012 Miyamoto ..... B23Q 17/0976 700/173
2012/0168189 A1 * 7/2012 Eckert ..... B25B 21/00 173/1
2012/0199372 A1 * 8/2012 Nishikawa ..... B25B 21/02 173/132
2012/0234566 A1 * 9/2012 Mashiko ..... B25F 5/00 173/93.5
2012/0279736 A1 * 11/2012 Tanimoto ..... B25B 23/1475 173/2
2012/0318552 A1 * 12/2012 May ..... B25B 23/1405 173/181
2013/0126202 A1 * 5/2013 Oomori ..... B25B 21/00 173/217
2013/0133912 A1 * 5/2013 Mizuno ..... B25B 23/1405 173/180
2013/0233584 A1 * 9/2013 Mashiko ..... B25B 23/147 173/181
2013/0264084 A1 * 10/2013 Beckman ..... B25B 21/00 173/2
2015/0047866 A1 * 2/2015 Sakai ..... B25F 5/00 173/179
2015/0122525 A1 * 5/2015 Wei ..... B25B 23/1405 173/179
2015/0231770 A1 * 8/2015 Kusakawa ..... B25B 23/1475 173/93.5
2016/0079887 A1 * 3/2016 Takano ..... H02P 1/22 318/431
2016/0121470 A1 * 5/2016 Mayer ..... B25B 23/1475 173/2
2016/0144497 A1 * 5/2016 Boehm ..... B25C 1/08 29/432
2016/0354905 A1 * 12/2016 Ely ..... B25B 21/008
2017/0008156 A1 * 1/2017 Miyazaki ..... B25F 5/00
2017/0036327 A1 * 2/2017 Murakami ..... B25B 21/026
2017/0173768 A1 * 6/2017 Dey, IV ..... B25B 23/1475
2017/0190032 A1 * 7/2017 Leong ..... B25B 23/1475
2017/0246732 A1 * 8/2017 Dey, IV ..... G01D 5/2006
2018/0117745 A1 * 5/2018 Murakami ..... B25D 11/04
2018/0290275 A1 * 10/2018 Asplund ..... B25B 21/02
2018/0354108 A1 * 12/2018 Lee ..... B25B 23/147
2019/0022836 A1 * 1/2019 Chu ..... B25B 21/02
2019/0118353 A1 * 4/2019 Woetzl ..... B25B 21/02
2019/0227528 A1 * 7/2019 Abbott ..... G06N 20/00
2019/0275650 A1 * 9/2019 Friberg ..... B25B 21/02
2019/0321949 A1 * 10/2019 Miyazaki ..... B25B 23/1475
2020/0008798 A1 * 1/2020 Evans ..... A61B 17/068
2020/0361064 A1 * 11/2020 Gaul ..... B25B 21/02
2020/0384620 A1 * 12/2020 Gaul ..... B25B 23/1475
2021/0199416 A1 * 7/2021 Boisard ..... B25F 5/00
2021/0370483 A1 * 12/2021 Roehm ..... B25F 5/00

(56) References Cited

U.S. PATENT DOCUMENTS

| | | | | |
|---|---|---|---|---|
| 2021/0394344 | A1* | 12/2021 | Mueckl | B25B 21/023 |
| 2022/0014128 | A1* | 1/2022 | Dai | H02P 6/28 |

FOREIGN PATENT DOCUMENTS

| | | | |
|---|---|---|---|
| EP | 2 985 117 | A1 | 2/2016 |
| EP | 2 985 118 | A1 | 2/2016 |
| EP | 3 115 154 | A1 | 1/2017 |
| JP | 2012-35358 | A | 2/2012 |
| WO | WO 2017/174415 | A1 | 10/2017 |

* cited by examiner

SETTING METHOD FOR THREADING CONNECTION BY MEANS OF IMPACT WRENCH

CROSS REFERENCE TO RELATED APPLICATIONS

This application claims the priority of International Application No. PCT/EP2018/086300, filed Dec. 20, 2018, and European Patent Document No. 17208763.7, filed Dec. 20, 2017, the disclosures of which are expressly incorporated by reference herein.

BACKGROUND AND SUMMARY OF THE INVENTION

The present invention relates to a setting method for an expansion anchor, Which is implemented as a control method for an impact wrench.

A control method of an impact wrench (1) for tightening a threaded connection (52) executes, in response to actuation of a pushbutton key (9), a sequence with the consecutive phases. In a first phase, an impact mechanism (3) of the impact wrench (1) exerts a predefined number N1 of rotary impacts on the threaded connection (52). During the first phase S1, a profile of a rotational angle Φ over time (t) is estimated. A pattern is adapted to the profile, and on the basis of the pattern a setpoint torque M0 is determined for a second phase S2 and a final rotational angle or a final number of impacts is determined for a third phase S3. During the second phase (S2), rotary impacts are exerted until an estimated torque M reaches the setpoint torque M0. During the third phase S3, rotary impacts are exerted on the threaded connection until a number of rotary impacts corresponds to the final number N3, or a rotational angle corresponds to the final rotational angle.

The following description explains the invention on the basis of exemplary embodiments and Figures.

DETAILED DESCRIPTION OF THE DRAWINGS

Identical or functionally identical elements are indicated by identical reference symbols in the Figures unless stated otherwise.

Figure 1:
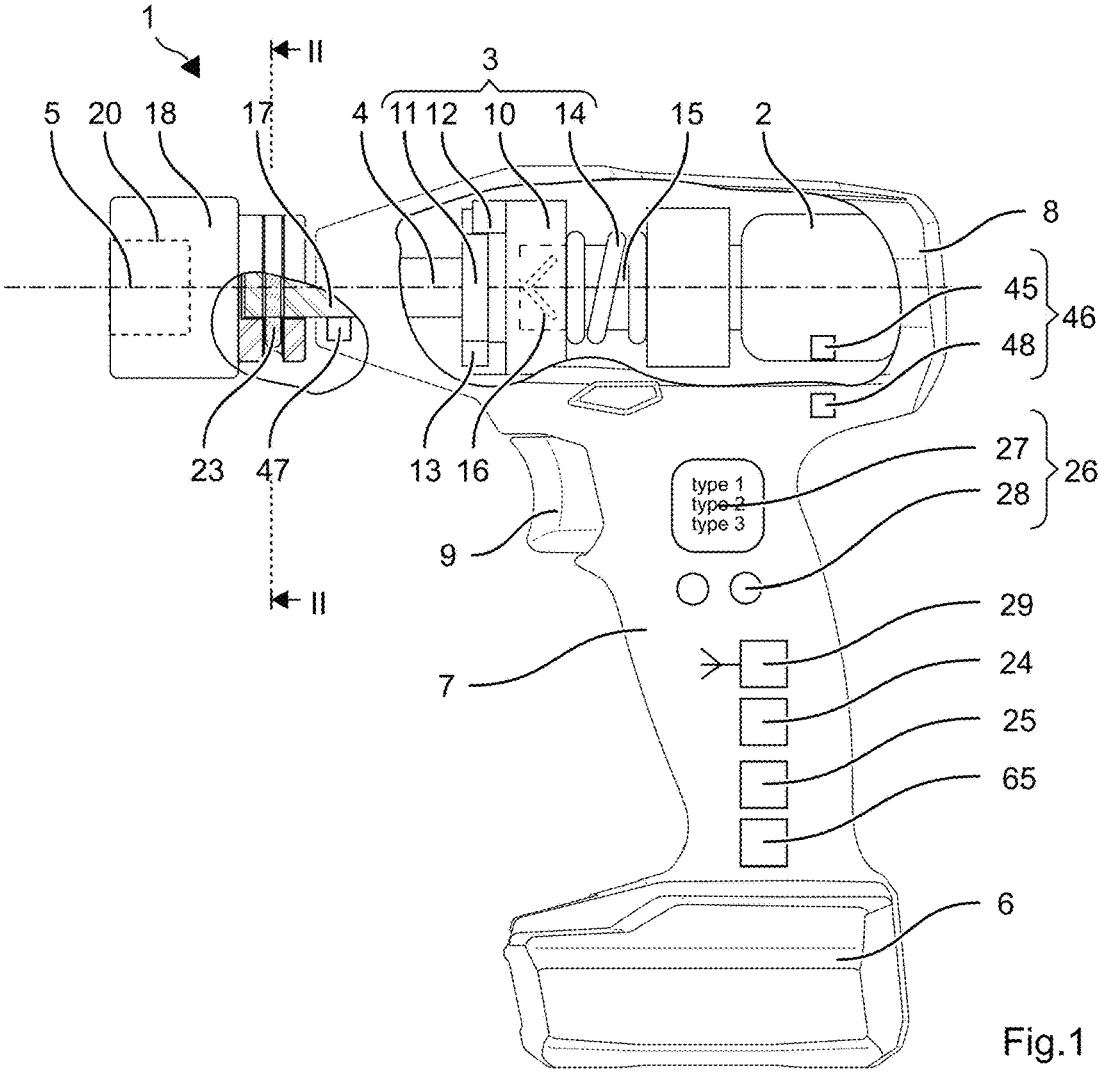
FIG. 1 shows an impact wrench.
Figure 2:
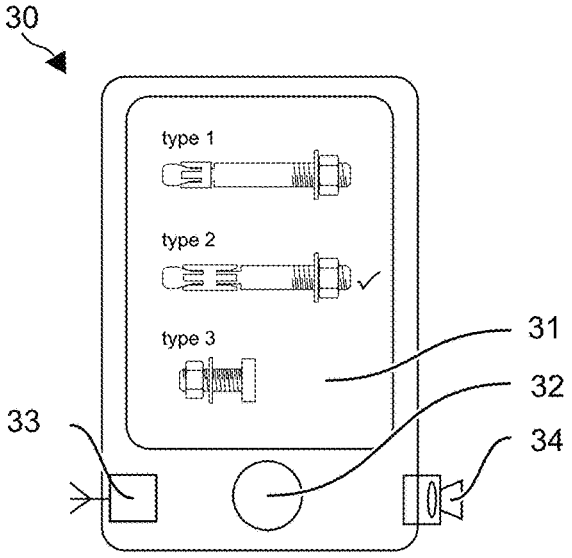
FIG. 2 shows an input element.

FIG. 1 is a schematic illustration of the impact wrench 1. The impact wrench 1 has an electric motor 2, an impact mechanism 3 and a output spindle 4. The impact mechanism 3 is driven continuously by the electric motor 2. As soon as a reactive torque of the output spindle 4 exceeds a threshold value, the impact mechanism 3 repeatedly exerts rotary pulses (rotary impacts) with a brief but at the same time with a very high torque on the output spindle 4. The output spindle 4 correspondingly rotates continuously or incrementally about a working axis 5. The electric motor 2 can be supplied via a battery 6 or supplied from the mains.

The impact wrench 1 has a handle 7 by means of which the user can hold and guide the impact wrench 1 during operation. The handle 7 can be attached to a machine housing 8 rigidly or by means of damping elements. The electric motor 2 and the impact mechanism 3 are arranged in the machine housing 8. The electric motor 2 can be switched on and off by means of a pushbutton key 9. The pushbutton key 9 is arranged, for example, directly on the handle 7 and can be actuated by the hand clasping the handle.

The exemplary impact mechanism 3 has a hammer 10 and an anvil 11. The hammer 10 has claws 12 which bear in the rotational direction on claws 13 of the anvil 11. The hammer 10 can transmit, via the claws 12, a continuous torque or brief rotary pulses to the anvil 11. A helical spring 14 prestresses the hammer 10 in the direction of the anvil 11, as a result of which the hammer 10 is held in engagement with the anvil 11. If the torque exceeds the threshold value, the hammer 10 is moved counter to the force of the helical spring until the claws 12 are no longer in engagement with the anvil 11. The electric motor 2 can accelerate the hammer 10 in the rotational direction until the hammer 10 is forced into engagement again with the anvil 11 by the helical spring 14. The kinetic energy which has been acquired in the meantime is transmitted by the hammer 10 in a brief pulse onto the anvil 11. One refinement provides that the hammer 10 is forcibly guided on a drive spindle 15 along a helical path 16. The forced guidance can be implemented, for example, as a helical depression in the drive spindle 15 and a spigot, engaging in the depression, of the hammer 10. The drive spindle 15 is driven by the electric motor 2.

The output spindle 4 protrudes from the machine housing 8. The protruding end forms a tool holder 17. The exemplary tool holder 17 has a square cross section. A plug nut 18 or similar tool can be plugged onto the tool holder 17. The plug nut 18 has a bushing 19 with a square hollow cross section which essentially corresponds in its dimensions to the tool holder 17. Opposite the bushing 19, the plug nut 18 has a mouth 20 for receiving the screw head 21, i.e., the hexagonal nut 22 or an analogous screw. The plug nut 18 can be secured to the output spindle 4 by means of a tool lock 23. The tool lock 23 is based, for example, on a pin which is plugged both through a drilled hole in the output spindle 4 and in the plug nut 18.

The impact wrench 1 has a control unit 24. The control unit 24 can be implemented, for example, by a microprocessor and an external or integrated memory 25. Instead of a microprocessor, the control unit can be implemented from equivalent discrete components, an ASIC, an ASSP, etc.

The impact wrench 1 has an input element 26, by means of which the user can select an operating mode. The control unit 24 then drives the impact wrench 1 in accordance with the selected operating mode. The control sequences of the various operating modes can be stored in the memory 25.

The input element 26 can contain, for example, a display 27 and one or more input keys 28. The control unit 24 can display the various operating modes stored in the memory 25 and, if appropriate, connection types associated therewith. The user can select the operating mode by means of the input keys 28. In addition, the user can input specifications such as the size, diameter, length, setpoint torque, load bearing capacity or manufacturer designation of a connection type. In an alternative refinement, the impact wrench 1 has a communication interface 29 which communicates with an external input element 30. The external input element 30 can be, for example, a cell phone, a laptop, or an analogous mobile device. In addition, the input element can be an additional module which can be arranged as an adaptor between the impact wrench 1 and the battery 6. In one application which is executed on the input element 30, a plurality of connection types are stored or the application can interrogate the connection types from a server via a mobile interface. The external input element 30 can display the expansion anchor or relevant information of the connection type on a display 31. The user selects a connection type by means of an input key 32 or a touch-sensitive display 31. The external input element 30 transfers the type designation or parameters of the selected connection type which are relevant for the control method to the impact wrench 1 via a communication interface 33 to the communication interface 29 of the impact wrench 1. The communication interface 29 is preferably radio-based, e.g., using a Bluetooth standard. In an addition or an alternative, the input element 28 or the external input element 30 can be provided with a camera 34 which can read a bar code on packaging of the connection type. The input element 28 determines the connection type on the basis of the read bar code and the bar codes stored in the memory 25. Instead of a camera 34, a laser-based bar code reader, an RFID reading device, etc., can be used to read a label on the packaging or on the connection type. In a further refinement, image processing in the input element 28 can detect the connection type on the basis of an image recorded by the camera 34, or can at least narrow down a selection of connection types, presented to the user, on the basis of the image.

Figure 3:
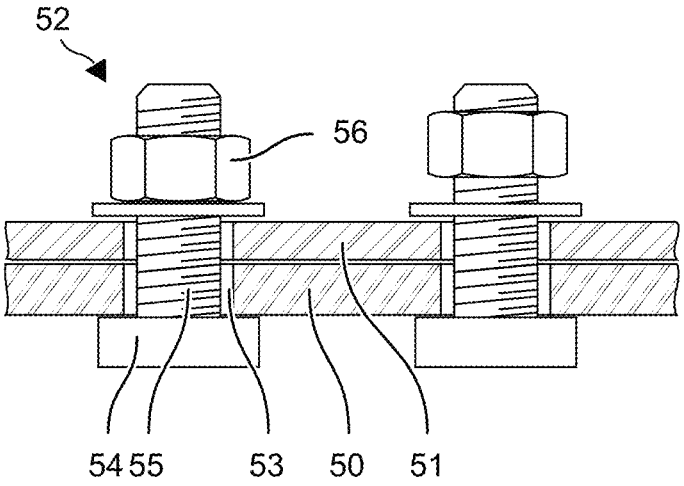
FIG. 3 shows a threaded connection of two steel plates.

FIG. 3 shows a schematic view of a threaded connection of two structural elements 50, 51 for steel construction in the field of structural engineering. The two structural elements 50, 51 are intended to be connected in a loadable fashion by means of one or more threaded connections 52. The structural elements 50, 51 can comprise, for example, beams, sheets, pipes, flanges, etc. The structural elements are composed of steel or other metallic materials. The structural elements 50, 51 are reduced in the illustration to their sheet-shaped sections which are in contact with one another. In the sections, one or more eyes 53 are provided. The eyes 53 of the two structural elements are aligned with one another by the user.

The threaded connections 52 can have a typical design with a screw head 54 on a threaded rod 55 and a screw nut 56. While the threaded rod 55 has a smaller diameter than the eyes 53, the screw head 54 and the screw nut 56 have a larger diameter than the eye 53. In the case of another threaded connection, the threaded rods can already be connected to the first structural element 50.

The user plugs the threaded rods 55 through the aligned eyes 53. The screw nut 56 is then fitted on. In the case of manual attachment, the user tightens the screw nut 56 with a torque wrench until a setpoint torque which is specified for the threaded connection is reached. The specification is indicated by the manufacturer of the threaded connection or is specified in relevant standards for steel construction. The setpoint torque ensures that the threaded connection cannot become detached under load, in particular vibrations. On the other hand, the threaded rod 55 is not intended to be unnecessarily loaded or in the worst case permanently damaged during the tightening of the screw nut 56.

Figure 4:
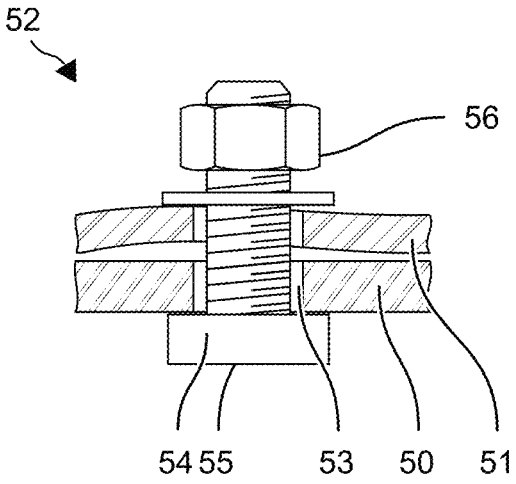
FIG. 4 shows a threaded connection of two steel plates.

The structural elements 50, 51 sometimes do not rest flat on one another, as is illustrated for example in FIG. 4. During the tightening of the threaded connection 52, the structural elements 51 become deformed. The reactive torque of the threaded connection 52 is therefore dependent not only on the type of screw but also on the structural elements 51 and their current prestress. In the case of manual tightening, this generally does not result in any additional difficulties, since the user can see whether the structural elements 50, 51 are already lying flat one on the other.

Tightening the threaded connections 52 with a torque wrench is a reliable and robust method, but the method is labor-intensive. This is particularly the case as this threaded connection 52 often typically contains a large number of screws. The threaded connections could basically be tightened with a conventional electric wrench and a corresponding shut-off means until the setpoint torque is reached. However, the user frequently cannot apply the necessary remaining force for the setpoint torque and there is a considerable risk of injury to the user.

The impact wrench 1 implements a robust setting method for the threaded connection 52. The user aligns the structural elements 51 with one another, plugs the threaded rods 55 through the second structural element 51 and fits on the screw nuts 56. The user can tighten the threaded connections 52 with the impact wrench 1. For this purpose, the user selects the "steel construction" operating mode and specifies the type of threaded connections 52.

While the torque which is output with a continuously rotating wrench can be measured extremely easily by means of the power consumption of the electric motor and the rotation speed of the output spindle, this is not possible owing to the mechanical decoupling between the output spindle 4 and the electric motor 2 in the case of an impact wrench 1. Direct measurement of the output torque by means of a sensor on the output spindle is technically very challenging and not suitable for the impact wrench owing to the high mechanical loads. A further problem arises as a result of the structural elements 50, 51 which deform during the tightening process. The influence of the structural elements 50, 51 on the torque, the rotational progress etc. is a priori unknown.

The setting method makes do with a three-phase tightening of the threaded connection 52. A first phase S1 serves for analyzing the threaded connection 52 and the structural elements 51, 52. A setpoint torque M0 and a final rotational angle $\varphi$ are defined on the basis of the analysis. During a subsequent second phase S2, the impact wrench 1 exerts impacts on the threaded connection 52 until an estimated torque M reaches the setpoint torque M. In a final third phase S3, the threaded connection 52 is then tightened by the final rotational angle $\varphi$.

Any type of threaded connection 52 is assigned a plurality of control parameters which are necessary for the subsequent satisfactory sequencing of the setting method. The control parameters are stored in the memory 25 in assignment to the type. The control unit 24 reads out the corresponding control parameters in response to the inputting or selection of the threaded connection 52. The control parameters are preferably retained until the user selects a different type of threaded connection 52. It is not necessary to select the threaded connection 52 before each individual setting process.

In the case of a pushbutton key 9 which is not actuated, the electric motor 2 is disconnected from the power supply, e.g., the battery 6, and does not rotate. The impact wrench 1 preferably goes into a standby mode when the pushbutton key 9 is released. When the pushbutton key 9 is actuated, the setting method starts. In a preparatory phase it is possible to check whether the user has previously selected the type of threaded connection 52 by means of one of the input elements 28. If a corresponding selection has not been made until now and the control parameters are not set, the user is required to do so and the impact wrench 1 remains inactive. Otherwise the electric motor 2 is connected to the power supply.

The drive spindle 15 is accelerated in response to actuation of the pushbutton key 9. The spindle is accelerated to a setpoint rotational speed Do. At the beginning, the reactive torque of the threaded connection 52 can be so low that the impact mechanism 3 is not activated. This preliminary phase is not described further below.

A first phase S1 of the setting method starts the first impact of the impact mechanism 3. During the first phase S1, the impact wrench 1 exerts a predefined number N1 of impacts. The predefined number N1 can be predefined by the selected type of threaded connection 52. The threaded connection 52 is tightened by a rotational angle Φ by the impacts. In the above example, the screw nut 56 is tightened by the rotational angle Φ with respect to the threaded rod 55. The rotation angle Φ is dependent not only on the threaded connection 52 but also on the structural elements 50, 51.

Figure 5:
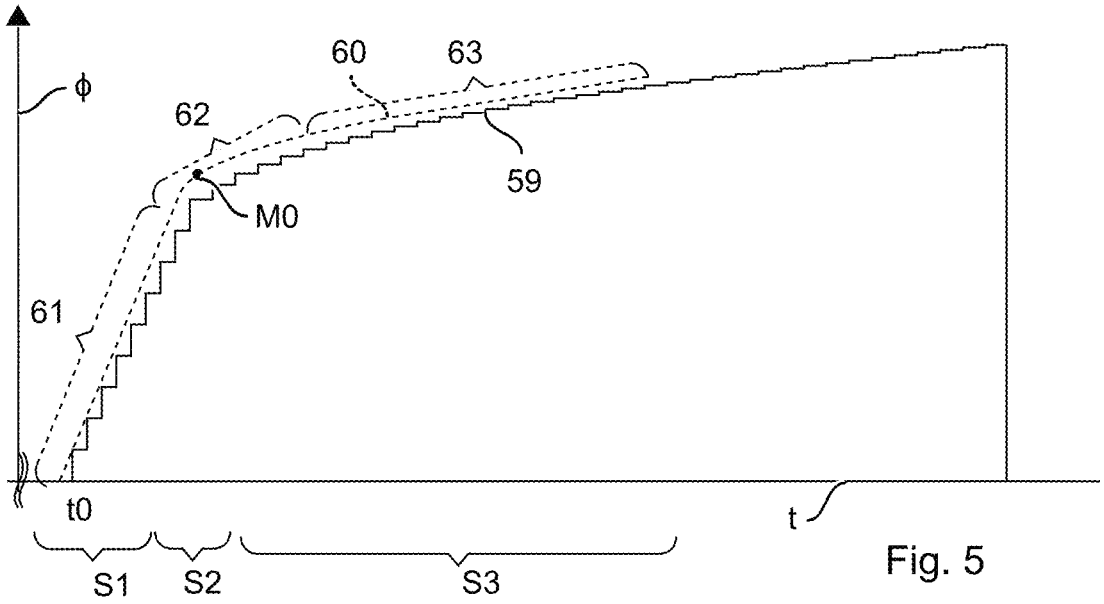
FIG. 5 shows a profile of a rotational angle.
Figure 6:
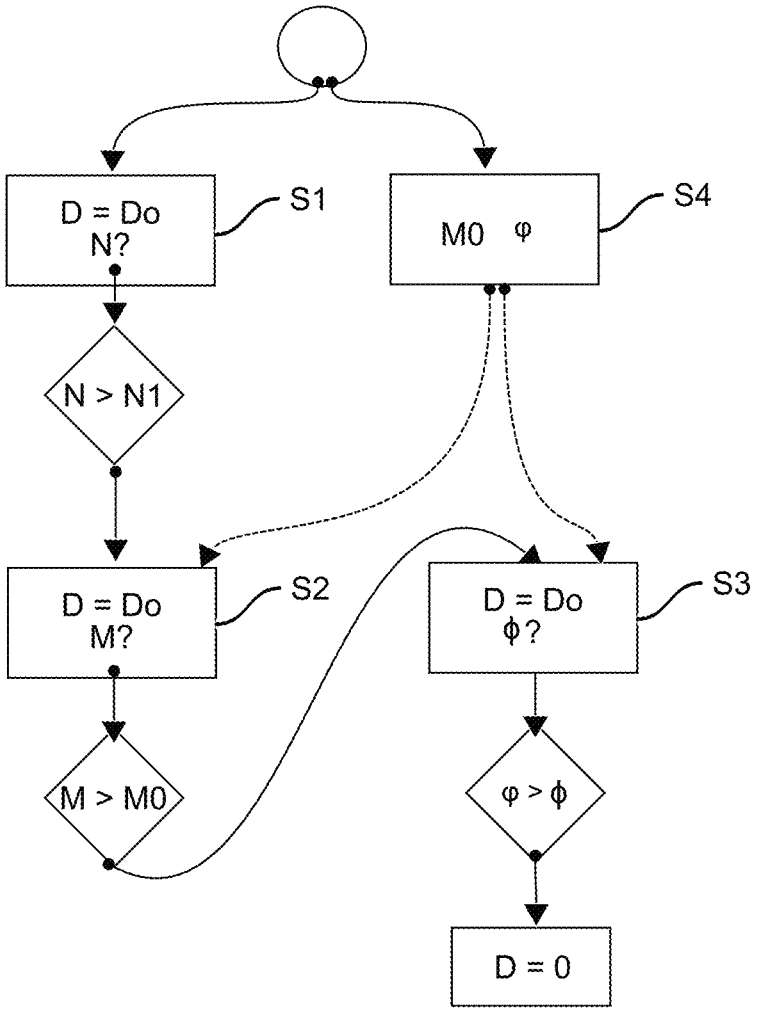
FIG. 6 shows a flow diagram relating to the "steel construction" operating mode

An estimation routine S4 compares the profile 59 of the rotational angle ϕ over time t with a pattern 60 (FIG. 5). The pattern 60 is a typical profile of the rotational angle determined from test series. The test series are carried out under various boundary conditions, e.g., different attachment elements, different prestressing of the attachment elements, etc. The pattern 60 has four to six degrees of freedom, which proves sufficient for classifying the different boundary conditions in steel construction. The patterns 60 can be stored as control parameters in assignment to the threaded connection 52. A pre-selection of the possible patterns 60 or a limitation of the degrees of freedom or of the values of the parameters for the degrees of freedom in accordance with the previously selected type of the threaded connection 52 can increase the reliability of the selection of the pattern 60 or adaptation of the pattern 60 and reduce the associated computational expenditure.

FIG. 5 shows by way of example a profile 59 in which the structural elements 51 rest flat one on top of the other. The estimation routine determines the current boundary condition by adapting the pattern 60 to the previous profile 59 of the rotational angle during the ongoing setting process. The preferred pattern 60 has three sections: a start 60, a center 61 and an end 62. The start has a linear profile with a first gradient. The end has a linear profile with a second gradient which is lower than the first gradient. The middle 61 is described, for example, by an exponential function with a monotonously decreasing gradient. Alternatively, the center can be described by other functions with a continuously monotonously decreasing gradient, e.g., exponential function, hyperbola. The transitions between the sections are preferably smooth. The pattern has four to six degrees of freedom. The degrees of freedom are or describe, inter alia, the gradient of the start, the gradient of the end, the duration of the start and the duration of the center. The comparison of the profile with the pattern can be made with an equalization calculus (fit) in which the numerical values for the degrees of freedom are varied, e.g., using the method of least mean squares. Since the computational power of the impact wrench 1 is limited, value ranges for the two gradients or their associated degrees of freedom can be predefined for each type of threaded connections 52. The value ranges are determined by test series and are stored in the predefined parameters.

The estimation routine S4 is preferably records the rotational angle ϕ over time, preferably starting with the first impact t0, in order to obtain measuring points for the comparison. A measuring point contains the measured rotational angle ϕ and the associated time t. The rotational angle ϕ can be estimated on the basis of the rotational angle of the drive spindle 15 between successive rotary impacts. The rotational angle ϕ of the plug nut 18 differs from the rotational angle of the drive spindle 15 by the angle between the claws 12 of the hammer multiplied by the number of impacts. A recording of the time can be approximated by chronologically recording the rotational angles ϕ. The measured values can be stored in a buffer.

The estimation routine S4 adapts the pattern 60 according to the predefined number N1 of rotary impacts. The number is made sufficiently large to obtain a good fit. The estimation routine S4 is concluded if a deviation of the pattern 60 from the measuring points lies within a predefined tolerance. If a deviation of the pattern is outside a tolerance or the minimum number of measuring points for the end of the pattern is undershot after the predetermined number of rotary impacts or the predefined duration, a fault message is output and the setting method is aborted.

Each of the patterns 60 is assigned a setpoint torque M0 and a final rotational angle φ. The setpoint torque M0 and the final rotational angle φ can be stored as a value or calculated from the pattern 60. The threshold value M0 is typically lower than the setpoint torque M9 for the threaded connection 52 when the latter is tightened by hand.

During the second phase S2, the electric motor 2 rotates the drive spindle 15 preferably at the predefined rotational speed Do. The control unit 24 can determine, for example, the rotational speed D of the drive spindle 15 directly with a rotational sensor 45 on the drive spindle 15 or indirectly by means of a rotational sensor on the electric motor 2. The rotational speed Do is a control parameter which is assigned to the threaded connection 52. The rotational speed influences the torque which is output by the impact wrench 1. The hammer 10 becomes detached from the anvil 11 after a rotary impact, and is accelerated by the drive spindle 15 up to the next rotary impact on the anvil 11. The next rotary impact takes place when the hammer 10 is correspondingly aligned again with the anvil 11. Owing to the largely predefined acceleration distance, a relatively high rotational speed of the drive spindle 15 results in a relatively high angular speed and a relatively high rotary pulse of the hammer 10 at the rotary impact. In a rough approximation it is assumed that a large part of the rotary pulse in the case of a rotary impact is transmitted to the anvil 11 and the output spindle 4. In test trials the rotary pulse or a variable describing the variable pulse can be determined for various rotational speeds and stored in a characteristic curve diagram.

During the second phase S2, a rotational angle δΦ, by which the output spindle 4 rotates owing to the rotary impact, is determined. The output torque M corresponds to the transmitted rotary pulse and the rotational angle δΦ, by which the output spindle 4 rotates owing to the rotary impact. The output torque M is estimated on the basis of the determined rotational angle δΦ and the approximate correlation between the rotary pulse and the rotational speed D. For example a characteristic curve diagram, which assigns a torque M or of a variable describing the torque to a pairing of the rotational speed D and rotational angle δΦ can be stored in the memory 25.

The rotary angle δΦ is determined by a sensor system 46 in the impact wrench 1. The sensor system 46 can, for example, directly sense the rotational movement of the output spindle 4 with a rotational sensor 47. The rotational sensor 47 can scan marks on the output spindle 4 inductively or optically. Alternatively or additionally, the sensor system 46 can estimate the rotational angle δΦ of the output spindle 4 on the basis of the rotational movement of the drive spindle 15 between two successive rotary impacts. The drive spindle 15 rotates between the two rotary impacts by the angular distance between the claws 12, e.g., 180 degrees, and if the anvil 11 has rotated, the drive spindle 15 rotates additionally by the rotational angle δΦ of the output spindle 4. The rotary impacts are sensed by a rotary impact sensor 48. The sensor system 46 senses for this purpose the rotational angle of the drive spindle 15 in the time period between two directly successive rotary impacts. The start and the end of the time period are sensed by sensing the rotary impacts by means of a rotary impact sensor 48. The rotary impact sensor 48 can sense, for example, the increased brief vibration in the impact range 1, which is associated with the rotary impact. The vibration is compared, for example, with a threshold value, and the start and the end correspond to the time when the threshold value is exceeded. The rotary impact sensor 48 can also be based on an acoustic microphone or infrasound microphone which senses a peak in the volume. A further variant of a rotary impact sensor 48 senses the power consumption or a fluctuation in the rotational speed of the electric motor 2. The power consumption rises briefly during the rotary impact. The rotational angle of the drive spindle 15 can be calculated, for example, from the rotational speed D or the signals of the rotational sensor 45 and the time period. The rotational angle δΦ of the output spindle 4 is determined as the rotational angle of the drive spindle 15 minus the angular distance between the claws 12.

The second phase S2 is ended when the estimated torque M exceeds the setpoint torque M0 which was previously determined by means of the pattern 60.

The second phase S2 is followed by a third phase S3 in which the threaded connection 52 is also rotated by the final rotational angle φ. The progress of the rotational angle during the third phase S3 can be estimated. The impact wrench 1 ends the tightening if the estimated rotational angle has reached the final rotational angle φ during the third phase S3. Alternatively, instead of a final rotational angle it is also possible to execute a final number N2 of impacts during the third phase S3.

The invention claimed is:

1. A control method of an impact wrench for tightening a threaded connection, comprising the step of:

in response to actuation of a pushbutton key, executing a sequence of consecutive phases which include:

a first phase in which an impact mechanism of the impact wrench exerts a predefined number of rotary impacts on the threaded connection, and during the first phase, a profile of a rotational angle over time is estimated and a pattern is adapted to the profile and on a basis of the pattern a setpoint torque is determined for a second phase and a final rotation angle or a final number of impacts is determined for a third phase;

the second phase in which rotary impacts are applied to the threaded connection until an estimated torque reaches the setpoint torque; and the third phase in which rotary impacts are exerted to the threaded connection until a number of rotary impacts corresponds to the final number or a rotational angle corresponds to the final rotational angle;

wherein the pattern has a first section with a first gradient and a second section which follows the first section and which has a second gradient, wherein the second gradient is lower than the first gradient.

2. The control method as claimed in claim 1, wherein the pattern has a third section with a continuously decreasing gradient and wherein the third section is disposed between the first section and the second section.

3. An impact wrench for tightening a threaded connection, comprising:

a pushbutton key;

an impact mechanism; and a control unit, wherein the control unit is configured to execute a control method of the impact wrench for tightening the threaded connection, the control method comprising the step of:

in response to actuation of the pushbutton key, executing a sequence of consecutive phases which include:

a first phase in which the impact mechanism of the impact wrench exerts a predefined number of rotary impacts on the threaded connection, and during the first phase, a profile of a rotational angle over time is estimated and a pattern is adapted to the profile and on a basis of the pattern a setpoint torque is determined for a second phase and a final rotation angle or a final number of impacts is determined for a third phase;

the second phase in which rotary impacts are applied to the threaded connection until an estimated torque reaches the setpoint torque; and the third phase in which rotary impacts are exerted to the threaded connection until a number of rotary impacts corresponds to the final number or a rotational angle corresponds to the final rotational angle.

* * * * *